US008371671B2

(12) United States Patent
Kitai

(10) Patent No.: US 8,371,671 B2
(45) Date of Patent: Feb. 12, 2013

(54) PRINTING APPARATUS

(75) Inventor: Satoshi Kitai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 12/940,868

(22) Filed: Nov. 5, 2010

(65) Prior Publication Data

US 2011/0109682 A1 May 12, 2011

(30) Foreign Application Priority Data

Nov. 10, 2009 (JP) ..... 2009-257418

(51) Int. Cl.
*B41J 29/38* (2006.01)

(52) U.S. Cl. ..... 347/14

(58) Field of Classification Search ..... 347/14, 347/15

See application file for complete search history.

(56) References Cited

U.S. PATENT DOCUMENTS

| | | | | |
|---|---|---|---|---|
| 5,214,442 | A | 5/1993 | Roller | |
| 2002/0015076 | A1* | 2/2002 | Uchikata et al. | 347/50 |
| 2003/0206224 | A1* | 11/2003 | Sakakibara et al. | 347/108 |
| 2005/0219293 | A1* | 10/2005 | Kachi | 347/14 |

FOREIGN PATENT DOCUMENTS

| | | | |
|---|---|---|---|
| JP | 5-270100 | A | 10/1993 |

* cited by examiner

*Primary Examiner* — Laura Martin
(74) *Attorney, Agent, or Firm* — Canon USA, Inc., IP Division

(57) ABSTRACT

A printing apparatus includes a conveying mechanism, a printing unit, a drying unit, and a control unit. The conveying mechanism conveys a sheet and the printing unit applies an ink onto the sheet conveyed by the conveying mechanism to perform print operation. The drying unit may dry the sheet on which an ink has been applied by the printing unit. The control unit controls the conveying mechanism, the printing unit, and the drying unit. The control unit controls the conveying mechanism to vary a sheet conveyance amount per unit time while print operation of one job is in progress. The control unit further controls the drying unit depending on variation in the sheet conveyance amount while the print operation of the one job is in progress.

12 Claims, 13 Drawing Sheets

| HEAD POSITIONS | HEATER POSITIONS | AMOUNT OF HEAT |
|---|---|---|
| A: NORMAL PRINT | — | MEDIUM |
| B: TRAILING EDGE PRINT | — | SMALL |
| C: DISCHARGE OPERATION | — | LARGE |

| HEAD POSITIONS | HEATER POSITIONS | AMOUNT OF HEAT |
|---|---|---|
| A: PRINT | PRINT | MEDIUM |
| B: — | NULL-PRINT | NULL |
| C: NULL-PRINT | PRINT | LARGE |

| HEAD POSITIONS | HEATER POSITIONS | AMOUNT OF HEAT |
|---|---|---|
| A: ONE-PASS PRINT | — | MEDIUM |
| B: TWO-PASS PRINT | — | SMALL |
| C: DISCHARGE OPERATION | — | LARGE |

| HEAD POSITIONS | HEATER POSITIONS | AMOUNT OF HEAT |
|---|---|---|
| WAIT EVENT OCCURS | — | NULL |
| NO WAIT EVENT OCCURS | — | LARGE |

FIG.11A

MAIN SCANNING DIRECTION

SUB-SCANNING DIRECTION

| | | | |
|---|---|---|---|
| 0×0 | 0×10 | 0×20 | 0×30 |
| 0×10 *NUMBER OF MAIN SCANNING PIXELS +0×0 | 0×10 *NUMBER OF MAIN SCANNING PIXELS +0×10 | 0×10 *NUMBER OF MAIN SCANNING PIXELS +0×20 | 0×10 *NUMBER OF MAIN SCANNING PIXELS +0×30 |
| 0×10 *NUMBER OF MAIN SCANNING PIXELS*2 +0×0 | 0×10 *NUMBER OF MAIN SCANNING PIXELS*2 +0×10 | 0×10 *NUMBER OF MAIN SCANNING PIXELS*2 +0×20 | 0×10 *NUMBER OF MAIN SCANNING PIXELS*2 +0×30 |
| 0×10 *NUMBER OF MAIN SCANNING PIXELS*3 +0×0 | 0×10 *NUMBER OF MAIN SCANNING PIXELS*3 +0×10 | 0×10 *NUMBER OF MAIN SCANNING PIXELS*3 +0×20 | 0×10 *NUMBER OF MAIN SCANNING PIXELS*3 +0×30 |

FIG.11B

MAIN SCANNING DIRECTION

SUB-SCANNING DIRECTION

| | | | |
|---|---|---|---|
| 0×0 | 0×10*OFFSET +0×0 | 0×10*OFFSET*2 +0×0 | 0×10*OFFSET*3 +0×0 |
| 0×10 | 0×10*OFFSET +0×10 | 0×10*OFFSET*2 +0×10 | 0×10*OFFSET*3 +0×10 |
| 0×20 | 0×10*OFFSET +0×20 | 0×10*OFFSET*2 +0×20 | 0×10*OFFSET*3 +0×20 |
| 0×30 | 0×10*OFFSET +0×30 | 0×10*OFFSET*2 +0×30 | 0×10*OFFSET*3 +0×30 |

PRINTING APPARATUS

BACKGROUND OF THE INVENTION

1. Field of the Invention

The present invention relates to a printing apparatus including a drying unit for drying a printed sheet.

2. Description of the Related Art

It is known that a drying time is shortened by installing a drying unit dedicated to the apparatus in a printing apparatus of an inkjet system, and subjecting a sheet on which ink is applied (deposited) to forced drying. Japanese Patent Application Open-Laid No. 5-270100 discusses an apparatus that can obtain appropriate drying state by variably controlling heater temperature of the drying unit and sheet conveyance speed depending on an ink amount used for printing, or a duty per unit area.

In a printing apparatus, a conveyance control may be performed, in which a conveyance speed (a sheet conveyance amount per unit time) is varied, even when print execution in one print job is in progress. Then, a conveyance speed of a sheet which passes through the drying unit is also varied in synchronism therewith. If an amount of heat of the drying unit is constant per time, heating amount is varied from area to area of the sheet resulting from variations of passing speeds through the drying unit of the sheet, and thus there is a possibility that an uneven drying may occur. The uneven drying may be visually identified as a color unevenness of an image.

SUMMARY OF THE INVENTION

The present invention is directed to providing a printing apparatus in which favorable images with little unevenly dried portion can be obtained, even when a sheet conveyance amount per unit time varies while print operation of one job is in progress.

According to an aspect of the present invention, a printing apparatus includes a conveying mechanism, a printing unit, a drying unit, and a control unit. The conveying mechanism conveys a sheet and the printing unit applies an ink onto the sheet conveyed by the conveying mechanism to perform print operation. The drying unit may dry the sheet on which an ink has been applied by the printing unit. The control unit controls the conveying mechanism, the printing unit, and the drying unit. The control unit controls the conveying mechanism to vary a sheet conveyance amount per unit time while print operation of one job is in progress. The control unit further controls the drying unit depending on variation in the sheet conveyance amount while the print operation of the one job is in progress.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 11A and 11B illustrate addresses on a memory of image data.

DESCRIPTION OF THE EMBODIMENTS

Various exemplary embodiments, features, and aspects of the invention will be described in detail below with reference to the drawings.

Figure 1:
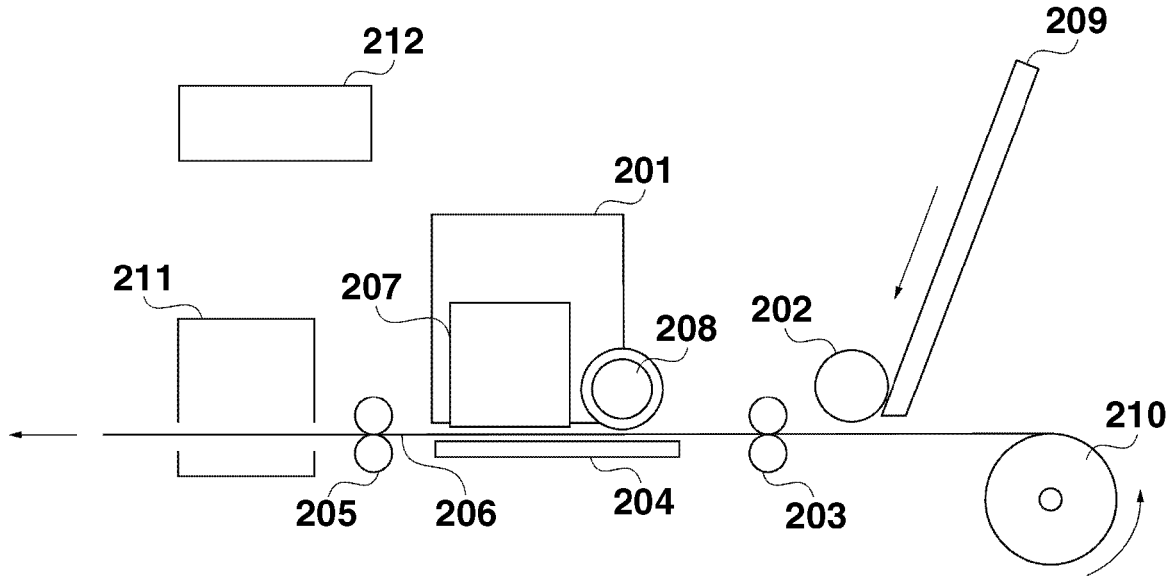
FIG. 1 is a schematic configuration diagram illustrating the entire configuration of a printing apparatus according to an exemplary embodiment.

A printing apparatus of an inkjet system according to an exemplary embodiment of the present invention will be described. FIG. 1 is a schematic configuration diagram illustrating the entire configuration of the printing apparatus. The apparatus includes a feeding unit for feeding a sheet, a conveying mechanism for conveying the sheet, a printing unit for applying an ink on the conveyed sheet to perform print operation, and a control unit.

The feeding unit includes a cut-sheet tray 209, a roll sheet holder 210, and a feeding roller 202. The feeding unit holds separately cut-sheets or continuous sheets, selects either sheets and feeds them to the printing unit arranged in the rear. The cut-sheet tray 209 stocks a plurality of cut-sheets in a stack, and the feeding roller 202 feeds out the cut-sheets one by one toward the printing unit. The roll sheet holder 210 holds rotatably the continuous sheet rolled up in a web shaped pattern, and the feeding roller 202 feeds out the continuous sheet toward the printing unit.

The conveying mechanism includes a conveyance roller 203, and a discharge roller 205. The conveyance roller 203 conveys a sheet 206 serving as a cut-sheet or continuous sheet in a sub-scanning direction (in an arrow mark direction in FIG. 1) when print operation is in progress. The sheet 206 conveyed by the conveyance roller 203 passes over a platen 204, and is discharged by the discharge roller 205. The conveyance roller 203 and the discharge roller 205 rotate synchronously. The rotating state of the conveyance roller 203 is detected by an encoder described below, and information about the conveyance state of the sheet 206 can be obtained.

The printing unit includes a carriage 201 and a print head 207. The carriage 201 is slidably supported by a guide shaft 208, over the platen 204, so that reciprocating scanning can be performed in the main-scanning direction intersecting (e.g., orthogonal) with the sub-scanning direction as a sheet conveying direction. Position information in the main-scanning direction of the carriage 201 is detected by the encoder described below. In the carriage 201, a print head 207 of an inkjet system is mounted. The print head 207 is used for applying an ink onto the sheet 206 to perform print operation. As the inkjet system, a system using a heating element, a piezoelectric element, an electrostatic element, or a micro-electro-mechanical system (MEMS) element can be adopted A drying unit 211 is provided on a path downstream of the discharge roller 205 from which the sheet is discharged. The drying unit 211 incorporates a heater therein, and is provided with a drying machine for heating a sheet to which an ink is applied by a printing mechanism including the print head 207. The drying unit 211 is capable of drying the sheet in a short time. The drying unit 211 has a drying capability (amount of heat per unit time) that is variably controlled. A control unit 212 includes a controller that performs various types of controls of the entire printing apparatus including the conveying mechanism, the printing unit, and the drying unit 211.

The sheet 206 fed from the feeding unit is conveyed to the printing unit by the feeding roller 202. In the printing unit, an image is formed on the sheet by alternately repeating an operation of printing of one-band portion while performing main-scanning of the print head 207 by the carriage 201, and a step-feeding of the one-band portion in the sub-scanning direction by the conveyance roller 203. The printing apparatus according to the present exemplary embodiment is a serial printer, what is called a serial printing system, which alternately repeats the main-scanning and the sub-scanning. The present invention is not limited to the serial printer, but can be also applied to a line printer that performs print operation while continuously conveying the sheet in the sub-scanning direction, using a long-length line head.

In a serial printing, a sheet is step-fed intermittently. Therefore, microscopically, the sheet conveyance speed varies minutely while repeating acceleration, constant speed, and deceleration in one-step feed from speed zero. In the present specification, upon having an appreciation of a total amount of sheet movement per unit time per unit time (average speed within a unit time), this is termed "conveyance amount per unit time" or simply "conveyance speed". In this case, the unit time is a predetermined period of time including a plurality of step-feed operations in a serial printer. In the line printer, since a sheet is continuously fed non-intermittently, the conveyance speed corresponds to "conveyance amount per unit time" or a "conveyance speed".

The sheet 206 on which an image has been formed by the printing unit is discharged from the printing unit by the discharge roller 205, and then is introduced into the drying unit 211. The sheet on which an ink has been applied is heated while passing through the drying unit 211, thereby drying is promoted. The printing unit and the drying unit 211 are close to each other, and an image at downstream side of an image on which print operation is in progress in the printing unit is positioned at the drying unit 211. In other words, a length of a conveyance path between the printing unit and the drying unit is shorter than a length in the conveying direction of the sheet to be used. For this reason, the sheet at the downstream side moves across the position of the drying unit 211, at a speed synchronized with a speed of the sheet conveyance associated with the print operation at the printing unit. Therefore, if a conveyance control is performed so that the conveyance speed (sheet conveyance amount per unit time) is varied even when print execution in one print job is in progress, the conveyance speed of the sheet which passes through the drying unit 211 is also varied in synchronism therewith.

Figure 2A:
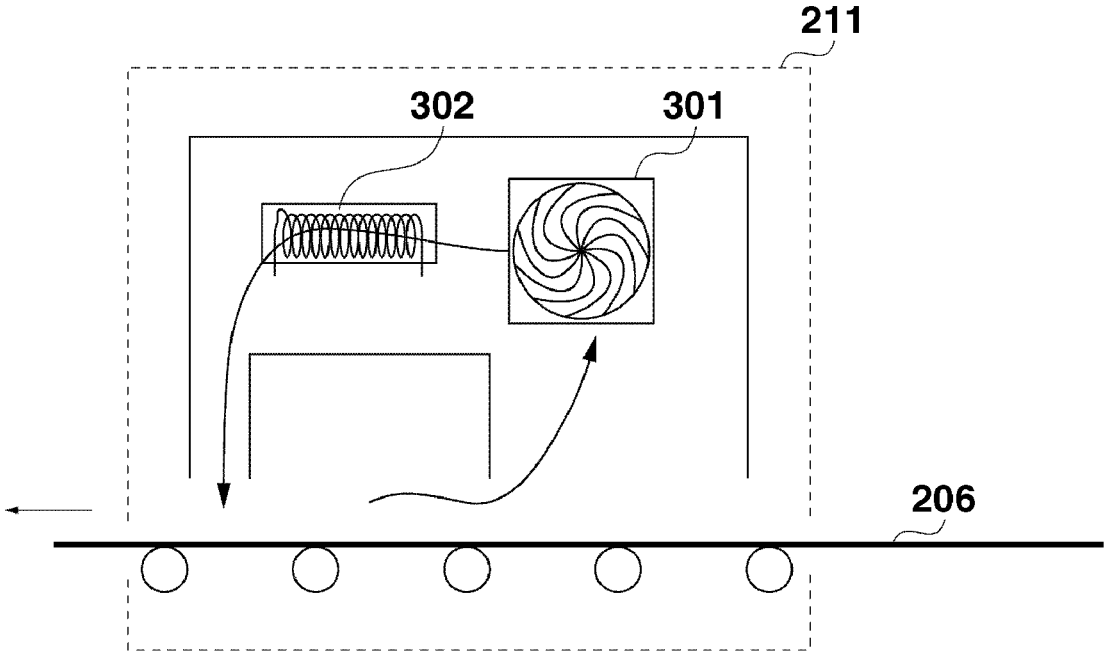
FIGS. 2A and 2B are configuration diagrams illustrating an internal configuration of a drying unit.
Figure 2B:
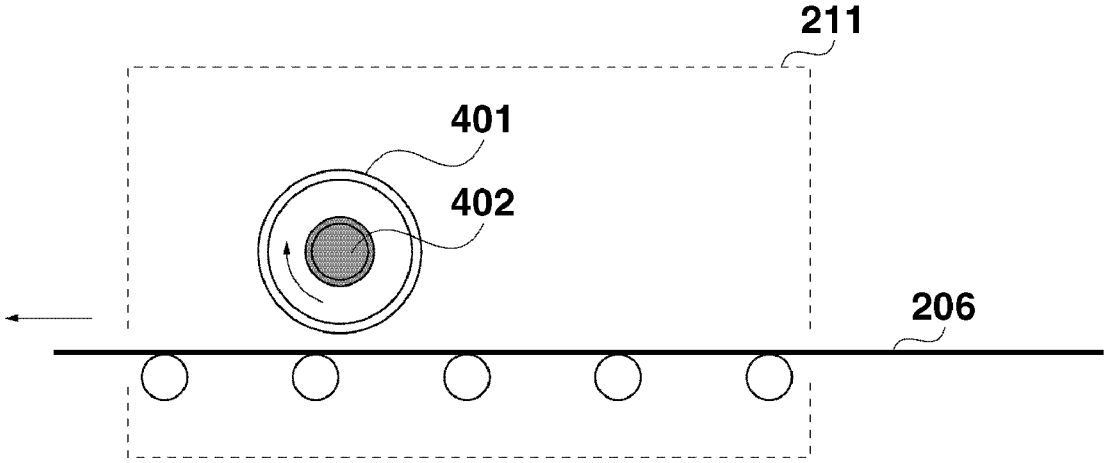

FIGS. 2A and 2B are configuration diagrams illustrating an internal configuration of the drying unit 211. FIG. 2A is an example of an air blowing type drying machine. A heater 302 generates heat, and a fan 301 blows hot air heated by the heater 302 onto an ink-applied surface of the sheet, thereby drying the sheet. A drying capability with respect to the sheet can be varied by making variable an electric energy to be introduced into the heater 302 and a number of revolutions of the fan 301. FIG. 2B is an example of a heating roller type drying machine, which is another example. A heating roller 402 includes internally a heater 401. The heating roller 402 at a high temperature rotates in contact with the ink-applied surface of the sheet, thereby drying the sheet. The drying capability with respect to the sheet can be varied by making variable an electric energy introduced into the heater 401.

Figure 3:
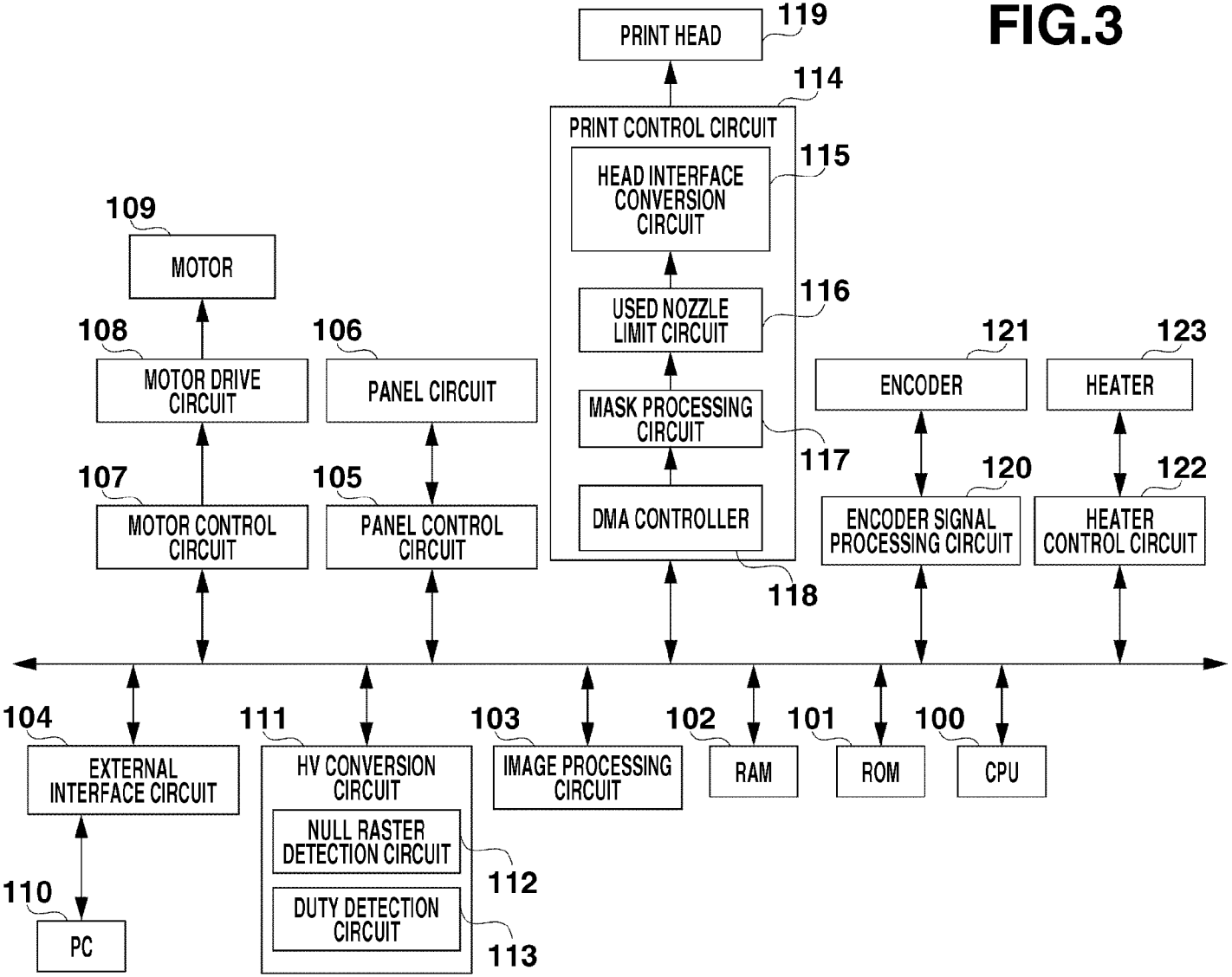
FIG. 3 is a block diagram illustrating a system configuration of the printing apparatus centering on a control unit.

FIG. 3 is a block diagram illustrating a system configuration of the printing apparatus centering on the control unit 212. A central processing unit (CPU) 100, a read-only memory (ROM) 101, and a random-access memory (RAM) 102 play the central role of control processing. The system further includes a motor control circuit 107 that controls a motor drive circuit 108 of a motor 109, and a print control circuit 114 that drives and controls the print head 207. The system further includes an encoder 121 for detecting a scanning position of the carriage 201 and a rotation of the conveyance roller 203, and an encoder signal processing circuit 120 that counts signals from the encoder 121 and measures the position. The system further includes an external interface circuit 104 for receiving print data from a personal computer (PC) 110 serving as a host device of the printing apparatus. The system further includes an HV conversion circuit 111 for realigning the input image data in order of easiness-to-eject of the print head, and an image processing circuit 103 for performing processing on the image data to be sent to the print head. The system further includes a heater 123 which is built in the drying unit, and a heater control circuit 122 for variably controlling amounts of heat generated by the heater 123.

The print control circuit 114 includes a direct memory access (DMA) controller 118 for reading out data from the RAM 102, a mask processing circuit 117 for dividing passes to print the data, ahead interface conversion circuit 115 for converting the print data into a predetermined transmission format, and so forth. In addition, the HV conversion circuit 111 performs the HV conversion processing, and includes a null raster detection circuit 112 for detecting whether data is present within one-raster, and a duty detection circuit 113 for discriminating print duty in a certain unit area, and the like.

Next, an operation of printing image data input from the PC will be described. Three sequences illustrated in FIG. 4, FIG. 5, and FIG. 6 are executed in a simultaneous parallel manner.

Figure 4:
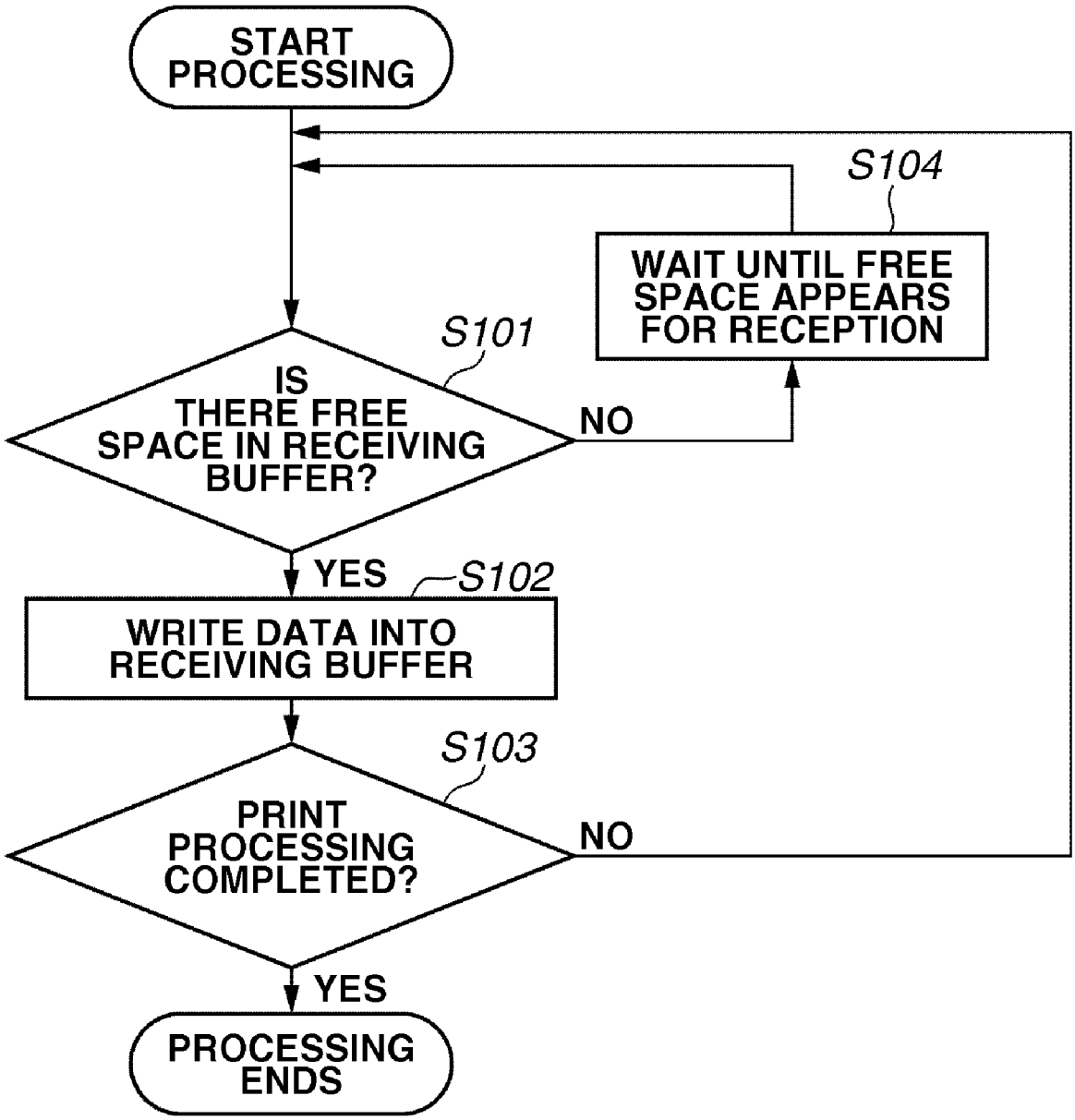
FIG. 4 illustrates a sequence in which image data input from a personal computer (PC) is received.

FIG. 4 is a flowchart illustrating a sequence in which image data input from the PC is received. In a system in which print data is transferred from the host PC via an interface such as, for example, a local area network (LAN) to the printing apparatus, transfer rate of the data is restricted, and as a result of which a step of waiting for printing may occur. Alternatively, the receiving buffer cannot receive data due to data overflow, thus the wait event for printing may occur. In step S101, the external interface circuit 104 determines whether there is free space (YES in step S101) or there is no free space (NO in step S101) in the receiving buffer. If NO (wait event occurs), then in step S104, the external interface circuit 104 waits for a free receiving space (wait) until a free space is created in the receiving buffer. If YES, then in step S102, the external interface circuit 104 once stores the image data in the receiving buffer on the RAM 102. Then, in step S103, the external interface circuit 104 determines whether print processing of one-job is completed (YES in step S103) or is not completed (NO in step S103). If YES, the sequence ends. If NO, the process routine returns to step S101, and the processing is repeated in a similar way.

Figure 5:
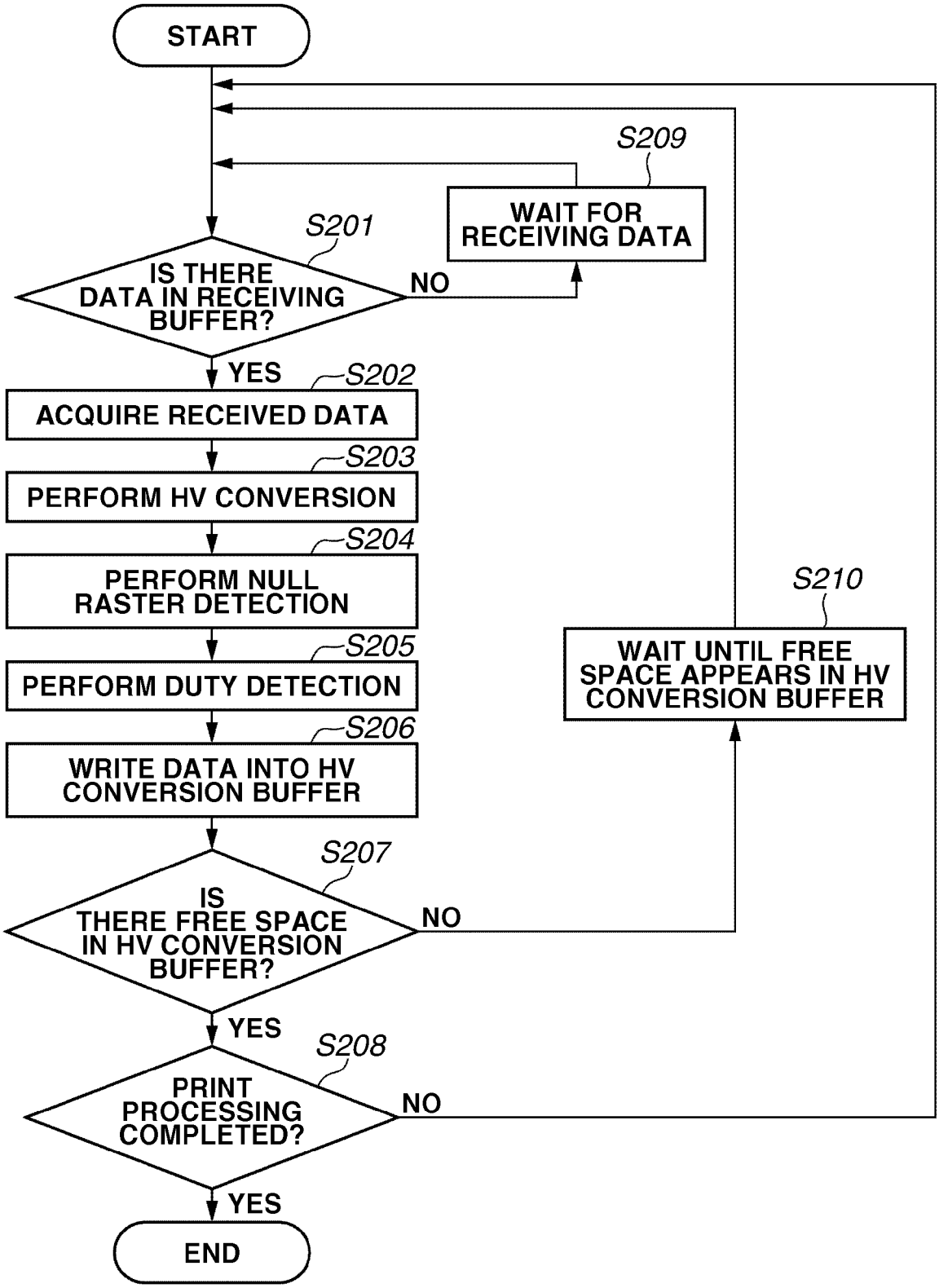
FIG. 5 illustrates a sequence in which image data of a receiving buffer is saved in an HV conversion buffer.
Figure 6:
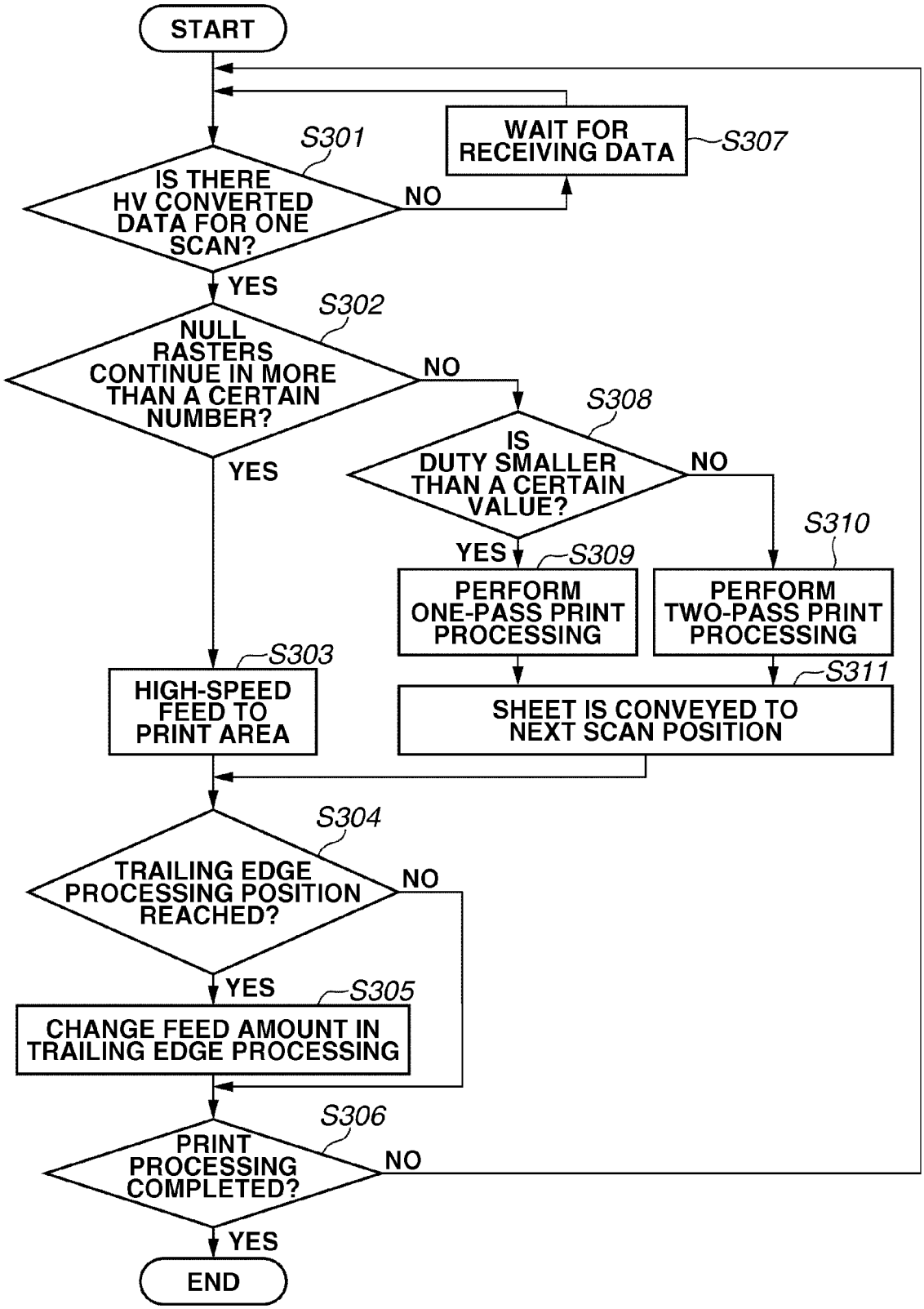
FIG. 6 illustrates a sequence in which image data held in the HV conversion buffer is printed.

FIG. 5 is a flowchart illustrating a sequence in which image data of the receiving buffer is saved in the HV conversion buffer. In this process, the image data to be input is data continuous in a raster direction. The print data generated by a printer driver of the PC is mostly data continuous in the raster direction. In order to make the data easy to use for printing by the printer, it is necessary to realign the data in a nozzle direction in which an ink is ejected. Firstly, in step S201, the external interface circuit 104 determines whether a certain amount of data is arrayed (YES in step S201) or not arrayed (NO in step S201) in the receiving buffer of the RAM 102. If NO (wait event occurs), then in step S209, the external interface circuit 104 waits for a free receiving space (wait) until a free space is created in the receiving buffer. If YES, then in step S202, the external interface circuit 104 once reads out the data from the receiving buffer. Then in step S203, the external interface circuit 104 HV (horizontal-vertical) converts an alignment of the print data to match a driving order of the print head. In addition to the HV conversion processing, Null raster detection (in step S204), and duty detection (in step S205) are performed in parallel manner. In step S206, the external interface circuit 104 stores the data which has been HV-converted, in the HV conversion buffer. In step S207, the external interface circuit 104 determines whether there is a free space (YES in step S207) or there is no free space (NO in step S207) in the HV conversion buffer. If NO, then in step S211, the external interface circuit 104 waits for a free space in the HV conversion buffer. Then, the process routine returns to step S201, and the similar processing is repeated. Then in step S103, the external interface circuit 104 determines whether print processing of one job is completed (YES) or not completed (NO in step S103). If YES, the sequence ends. If NO, the processing routine returns to step S201, and the similar processing is repeated.

Figure 12:
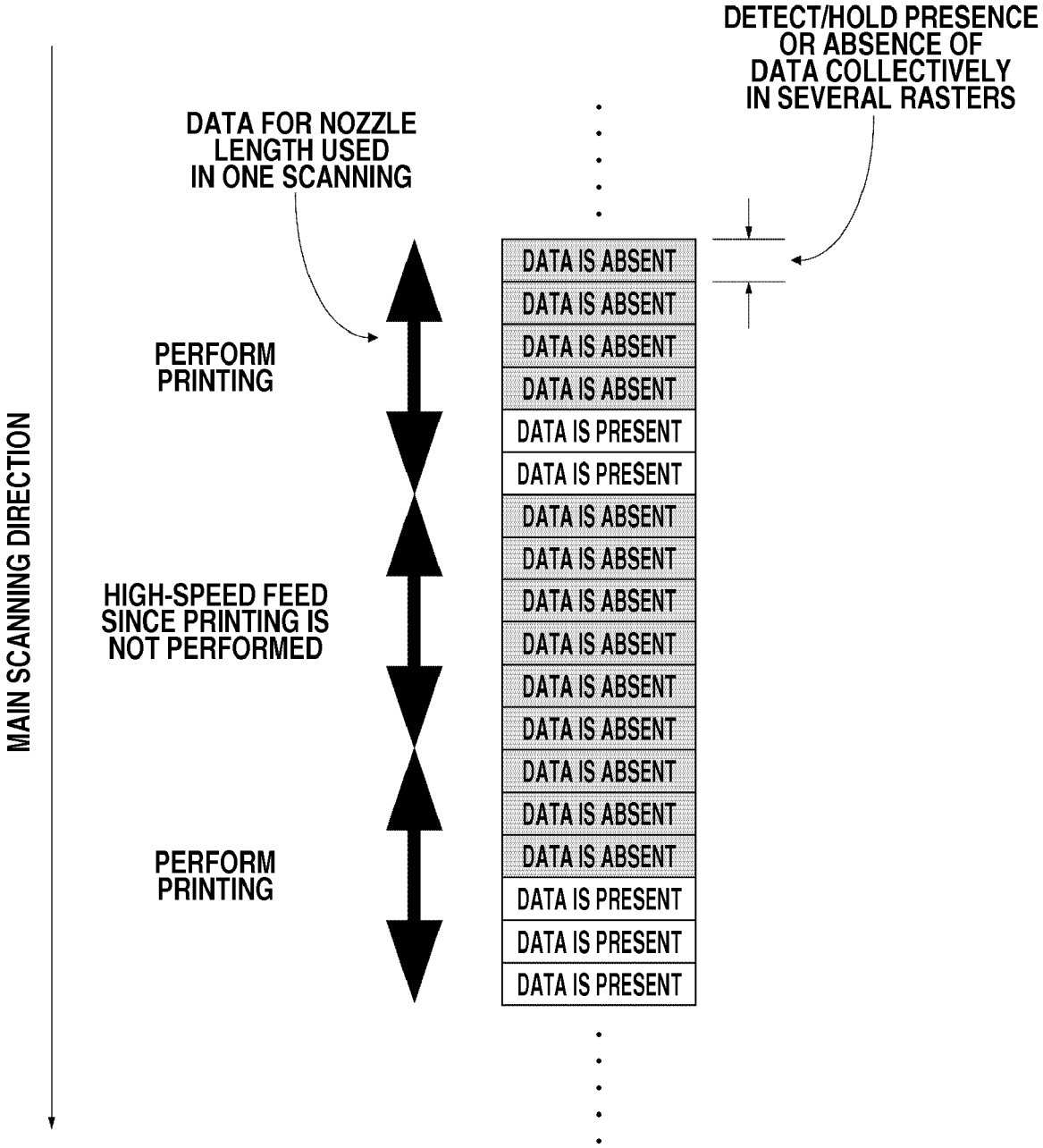
FIG. 12 illustrates a relationship between Null raster information and printing method.

In the HV conversion, the image data aligned in main-scanning/sub-scanning directions is realigned in order of addresses like the realignment from FIG. 11A to 11B. An access frequency to the RAM 102 can be reduced by performing Null raster detection in step S204, and a duty detection in step S205 in parallel manner, in addition to the HV conversion processing. Null raster information/duty information of the received data are separately stored in the RAM 102, as data arrays like those in FIG. 12 and FIG. 13 and used for sheet conveyance control.

FIG. 6 is a flowchart illustrating a sequence in which image data held in the HV conversion buffer is printed. First in step S301, the external interface circuit 104 determines whether there is a lineup of print data that has been HV-converted of one-scan portion (in case of one-pass printing, the print head length×main-scanning length of sheet surface, at minimum) (YES in step S301) or not (NO in step S301). If NO (wait event occurs), then in step S307, the external interface circuit 104 waits until the processing becomes YES. If YES, the external interface circuit 104 starts printing. The sheet is fed and conveyed to a predetermined position in the sub-scanning direction by the feeding unit, and the print head 207 performs scanning operation in the main-scanning direction. A position in the main-scanning direction of the carriage 201 is detected by the encoder and its processing circuit, and the image data corresponding to the positions in the main-scanning direction is read out from the RAM 102, and a driving signal is sent to the print head 207. Processing methods are different between an image which has many blanks like character-centric document print and an otherwise image. In step S302, it is determined whether a number of Null rasters continues continuously in not less than a certain number (YES in step S302) or does not continue (NO in step S302). If YES, then step S303, the sheet is skip (blank feed) conveyed at a higher speed than usual to a next printing area. When the sheet reaches a position where the next printing area faces the print head, main-scanning of the print head is performed. On the other hand, if NO, then in step S308, it is determined whether the print duty is equal to or smaller than a certain value (YES in step S308) or larger than a certain value (NO in step S308). If NO, then in step S309, one-scan printing (one-pass printing) is performed. If YES, then in step S310, two-scan printing (two-pass printing) is performed. Since the print duty is larger than a certain value, the aim of the two-scan printing is to divide the data into a plurality of scans to print the data in order to restrict an ejection amount during one scan.

Figure 13:
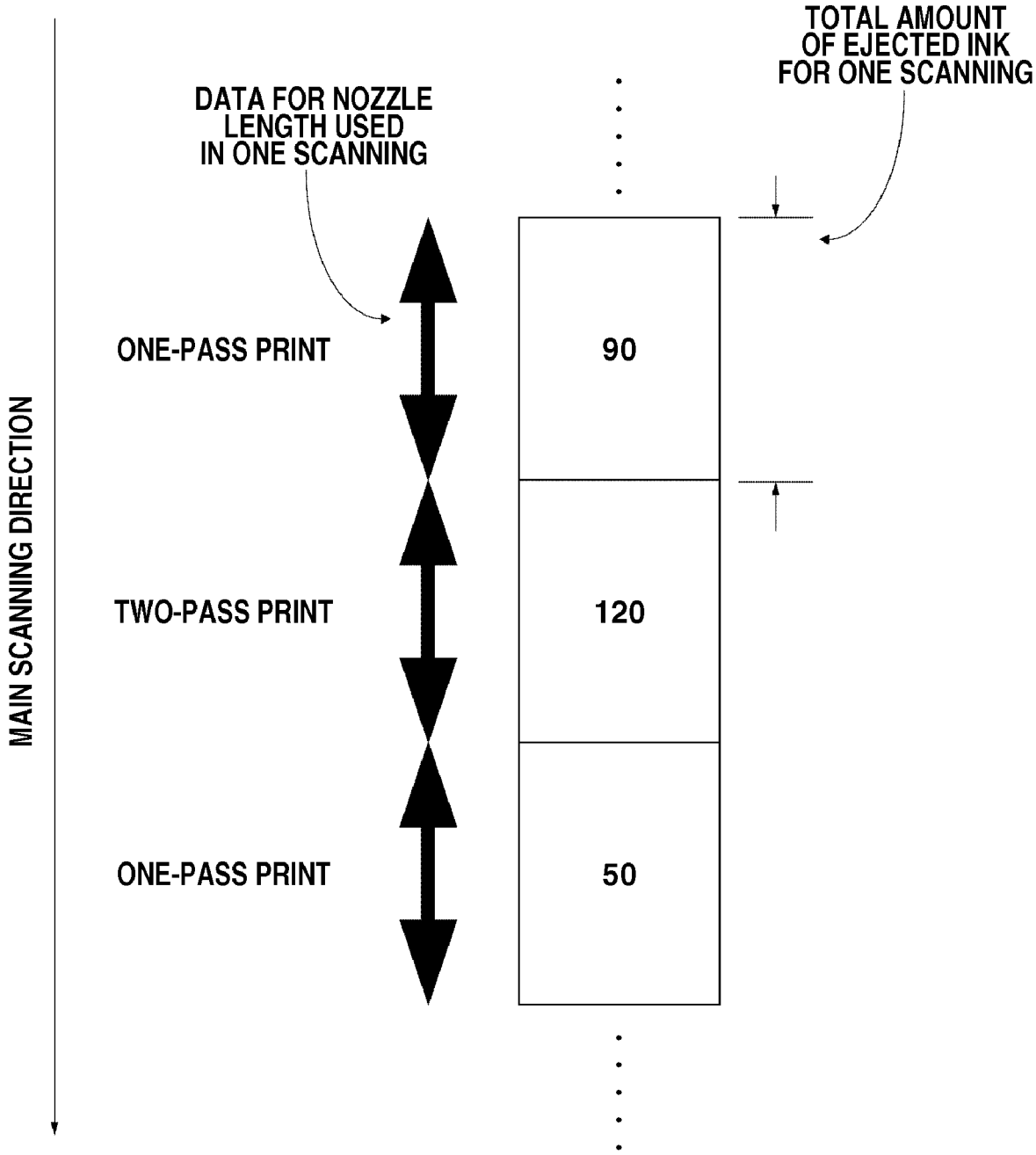
FIG. 13 is an example illustrating a relationship between duty information and printing method.

FIG. 13 is an example representing a relationship between duty information and printing method, taking a duty value calculated based on a certain standard as 100. On one-pass printing mode basis, an area where a duty is locally high (duty value is not less than 100) is switched to two-pass printing. In the two-pass printing, it is necessary to divide the original image data which has been binarized. This can be implemented by reducing a print duty by reading out the original image data stored in the RAM 102, and performing masking operation on the image data. For example, a mask pattern is configured by a zigzag arrangement of 50% duty, and uses a pattern which is reversed between the interface of one-pass and two-pass. Alternatively, nozzles may be used by simply restricting them to upper or lower halves. As a number of print passes, one-pass/two-pass is here taken as an example, but the number of passes is not limited to this. Instead, the number of passes may be, for example, two-pass/4-pass, or further greater than this. When printing is thus finished in step S309 or step S310, then in step S311, the sheet is conveyed to the next print position.

When a sheet trailing edge area passes through the conveyance roller 203, the sheet will be conveyed only by the discharge roller 205, and as a result of which conveyance accuracy is degraded. Thus, degradation of conveyance accuracy will be eased by changing a printing method at the sheet trailing edge. In step S304, it is determined whether the sheet trailing edge has reached a predefined processing position of sheet trailing edge area (YES in step S304) or has not reached (NO in step S304). This determination is performed by monitoring detection output of the encoder provided on the conveyance roller 203. If YES, then in step S305, a sheet conveyance amount per unit time is varied to a smaller value than usual so that it becomes a value suitable for the trailing edge processing. In conjunction with this switching, the trailing edge print is performed by restricting a number of nozzles which the print head uses to match a sheet feeding amount. Then in step S306, it is determined whether print processing of one job is completed (YES in step S306) or not completed (NO in step S306). If YES, the sequence ends. If NO, the process routine returns to step S301, and the similar processing is repeated. Further, if the determination in step S304 is NO, the process skips step S305 and transfers to step S306.

As described above, the processing of respective sequences in FIG. 4, FIG. 5, and FIG. 6 are executed in parallel manner. The external interface circuit 104 checks for a free space state of the receiving buffer each time data is transmitted from the PC and writes the data therein. The processing of FIG. 4 or FIG. 5 repeats a wait and an execution depending on whether a number of retained data of the receiving buffer, or of the HV conversion buffer exceeds a certain value. In step S201, the HV conversion circuit 111 acquires the received data at the time point when a certain number of data is retained in the receiving buffer, then in step S206, checks for a free space state of the HV conversion buffer and writes therein the data that has been HV converted. On the other hand, in step S301, the print control circuit 114, at a time point when data of one scan portion is retained in the HV conversion buffer, reads out the data from the HV conversion buffer, converts the data into data format that matches the print head, and drives the print head during one-scan. Then, image formation for one piece of sheet is completed by repeating the main-scanning of the print head and the sub-scanning of the sheet.

As described above, conveyance is controlled to vary a sheet conveyance amount per unit time when print execution in one print job is in progress. The control methods are classified into the following (1) to (4).

(1) Trailing Edge Print

A conveyance speed is varied between when and before print operation is performed on a sheet trailing edge. The sheet conveyance amount per unit time is decreased, and the number of nozzles used in one-scan of the print head is also lessened.

(2) Skip Conveyance

In a case where printing area and a non-printing area are mixed like a character-centric document, the non-printing area is skip-conveyed at a higher speed than that of the printing area.

(3) Print Duty

A number of print passes and a sheet conveyance speed are varied depending on print duty.

(4) Wait Event Occurrence

If a wait event should occur when print operation is in progress, the sheet conveyance is temporarily stopped (speed is zero).

As described in (1) to (4), the conveyance amount per unit time is varied while print operation of one job is in progress. The printing apparatus according to the present exemplary embodiment controls drying capability of the drying unit 211 to vary in association with this variation in the conveyance amount per unit time. As to respective configurations (1) to (4) described above, a control method of the drying unit 211 by the control unit 212 will be described below.

(1) Trailing Edge Print

Figures 7A, 7B:
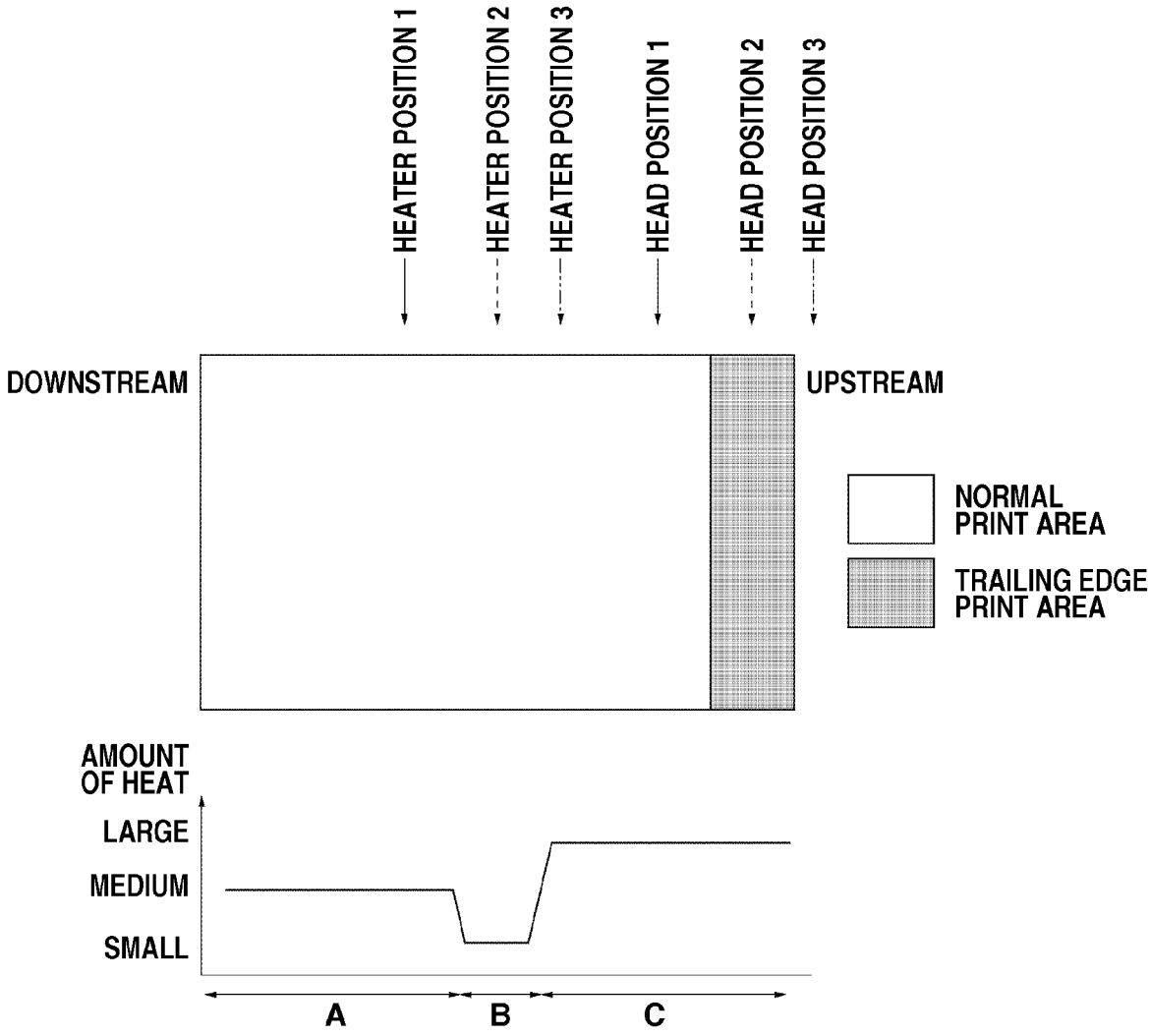
FIGS. 7A and 7B illustrate heater control at the time of trailing edge print control.

A case where print controls are varied between a normal printing and trailing edge print will be described. FIGS. 7A and 7B illustrate a heater control at the time of trailing edge print control, and represent a relationship of amounts of heat of the heater to the sheet. FIG. 7A illustrates amounts of heat of the heater in each timing A to C. FIG. 7B illustrates distribution of amounts of heat applied to the sheet, wherein white indicates a normal printing area on the sheet and gray indicates a trailing edge print area. In addition, FIG. 7B illustrates a positional relationship between sheet heating positions of the heater of the drying unit 211 while the sheet is being conveyed, and ink-applied positions of the head. Taking left-side as a sheet leading edge (downstream), and right-side as a sheet trailing edge (upstream), the ink-applied positions of the print head to the sheet are represented as a head position 1, a head position 2, and a head position 3 in order of time sequence in which the sheet is conveyed. Since heating positions of the heater are always spaced apart by a certain distance toward downstream side from respective head positions of the print head, they are represented as a heater position 1, a heater position 2, and a heater position 3, respectively.

(1) Trailing Edge Print

A case where print controls are varied between the normal printing and the trailing edge print will be described. FIGS. 7A and 7B illustrate a heater control at the time of trailing edge print control, and represent a relationship of amounts of heat of the heater to the sheet. FIG. 7A illustrates amounts of heat of the heater in each timing A to C. FIG. 7B illustrates distribution of amounts of heat applied to the sheet, wherein white indicates a normal printing area on the sheet and gray indicates a trailing edge print area. In addition, FIG. 7B illustrates a positional relationship between sheet heating positions of the heater of the drying unit 211 while the sheet is being conveyed, and the ink-applied positions of the head. Taking left-side as a sheet leading edge (downstream), and right-side as a sheet trailing edge (upstream), the ink-applied positions of the print head to the sheet are represented as a head position 1, a head position 2, and a head position 3 in order of time sequence in which the sheet is conveyed. Since heating positions of the heater are spaced apart by a certain distance always toward downstream side from respective head positions of the print head, they are represented as a heater position 1, a heater position 2, and a heater position 3, respectively.

In FIG. 7A, the timing A is a stage in which the print head is located at a normal printing area (head position 1). The sheet is conveyed at a standard conveyance speed, and amount of heat of the heater is set to "medium" as a standard. The timing B is a stage in which, after passing the standard printing area, the print head has reached the sheet trailing edge position (head position 2). Since the sheet becomes smaller in conveyance speed than the standard, a length of time during which the sheet remains at the heating position of the heater becomes all the longer. In accordance with the longer remaining time, the amount of heat of the heater is set to "small", which is smaller than "medium". Respective values of "medium" and "small" are set so that a total cumulative amount of heat (amount of heat×time) of the area heated by the heater at this time becomes substantially equal to that at the timing A. The timing C is a stage where the trailing edge print ends and the sheet is discharged. The head position 3 is no longer situated on the sheet. Discharge is performed at much higher conveyance speed than the standard in order to enhance printing throughput. To match such conveyance speed, amount of heat of the heater is set to "large" which is larger than "medium". Respective values of "medium" and "large" are set so that a total cumulative amount of heat (amount of heat×time) of the area heated by the heater at this time becomes substantially equal to those at the timing A and timing B. According to the present example, area where ink is applied on the sheet will be eventually heated with substantially no unevenness, and drying operation with no unevenness as a whole is performed, and furthermore, printing with less image unevenness and with favorable image quality will be implemented.

(2) Skip Conveyance

Figures 8A, 8B:
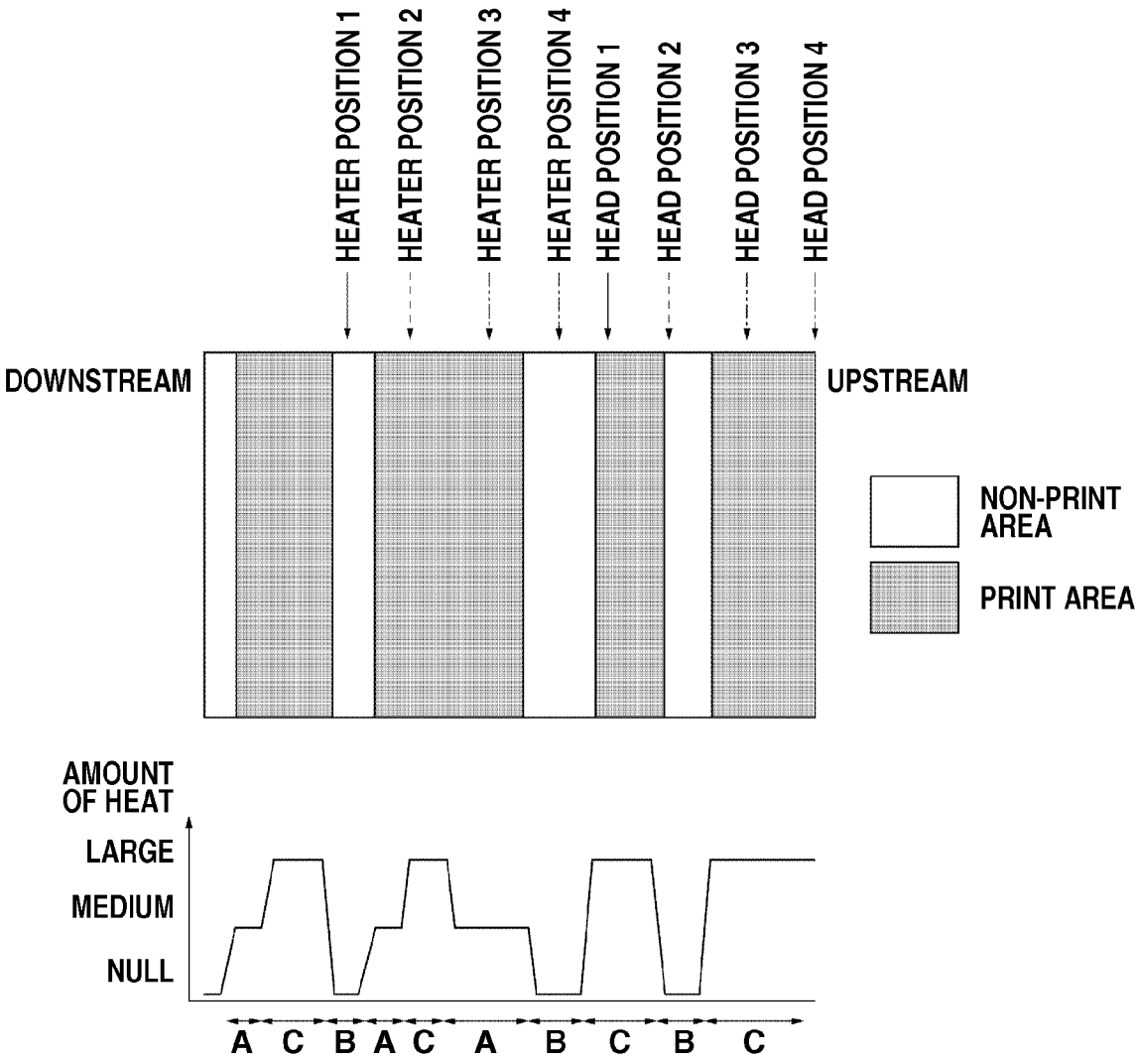
FIGS. 8A and 8B illustrate heater control when printing area and non-printing area are mixed.

A print control when the printing area and the non-printing area are mixed will be described. FIG. 8 illustrates a heater control at the time of printing control of mainly character-centric document, when the non-printing area is included in an image, and represents a relationship of an amount of heat of the heater to a sheet. FIG. 8A illustrates amounts of heat of the heater at each timing A to C. FIG. 8B illustrates distribution of amounts of heat applied to the sheet, and white indicates the non-printing area and gray indicates the printing area. Further, FIG. 8B illustrates positional relationship between the sheet heating positions of the heater of the drying unit 211 to the sheet while the sheet is being conveyed, and the ink-applied positions of the head. In this example, there is a head position 1 through a head position 4, and a heater position 1 through a heater position 4 corresponding to these head positions.

In FIG. 8A, the timing A corresponds to a case where the print head is located at the printing area (head position 3). The sheet is conveyed at a standard conveyance speed, and an amount of heat generated by the heater is set to standard "medium". The timing C corresponds to a case where the print head is located at the non-printing area (head position 2). The sheet is skip-conveyed at a conveyance speed larger than the standard without being printed, and amount of heat of the heater is set to "large" which is larger than "medium". Respective values of "medium" and "large" are set to a value such that a total cumulative amount of heat (amount of heat× time) of the area heated at this time by the heater become substantially equal to those at the timing A and the timing C. The timing B is a case where the printing area is not present at the heater position. Regardless of whether the head position is present at the printing area, an amount of heat of the heater is null. In this way, necessary and sufficient amount of heat can be applied only to the printing area. According to the present example, an area where ink is applied on the sheet will be eventually heated substantially with no unevenness, so that drying with no unevenness is performed as a whole, and furthermore, printing with less image unevenness and favorable image quality will be performed.

(3) Print Duty

A print control for varying a number of print passes and a sheet conveyance speed depending on a print duty will be described. Under the control, the print duty within a particular unit area is determined, and nozzles to be used is restricted if it exceeds a permissible value, thus avoiding excessive power consumption.

Figures 9A, 9B:
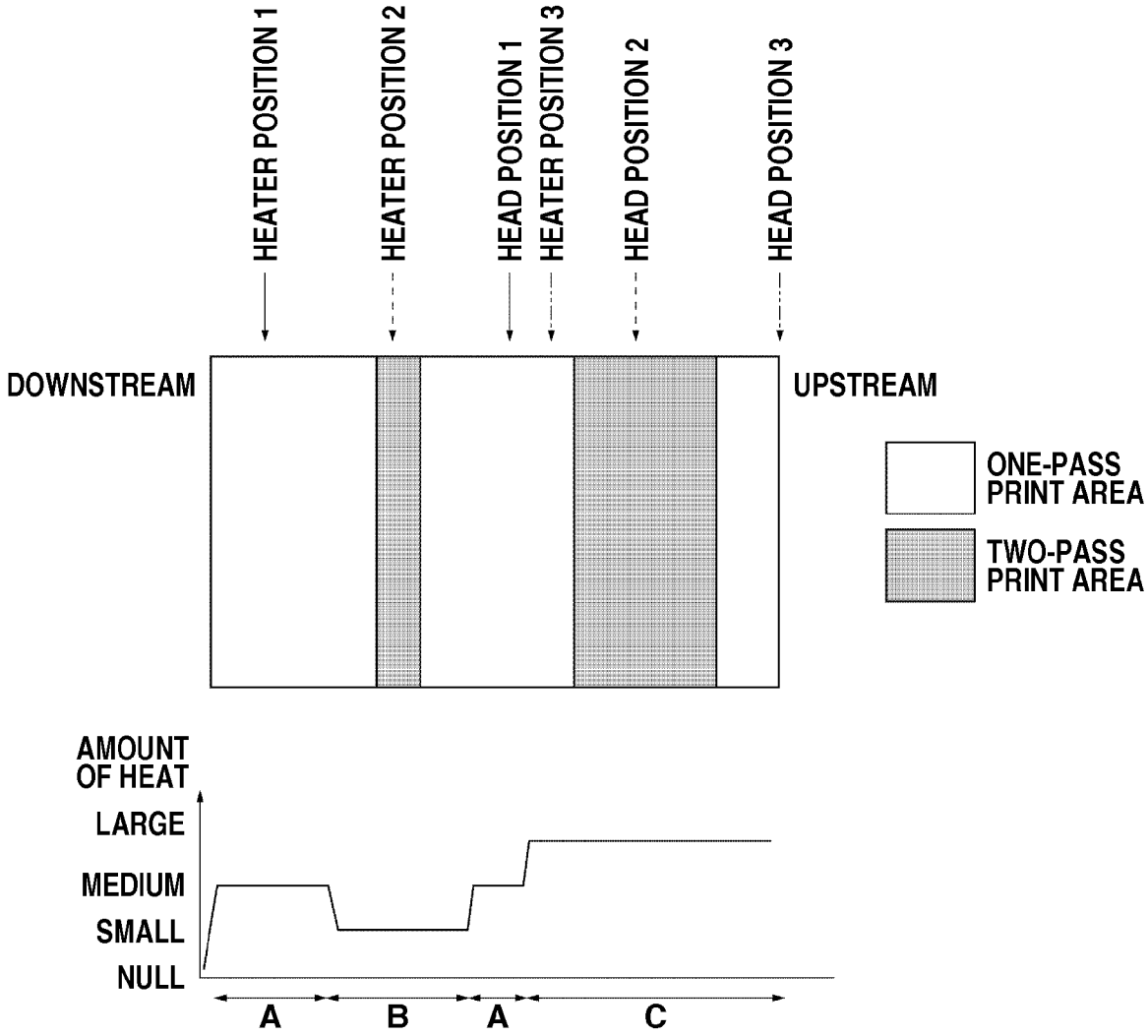
FIGS. 9A and 9B illustrate heater control when a number of print passes and a sheet conveyance speed are varied depending on print duty.

FIG. 9 illustrates a heater control at the time of printing control for varying a number of print passes and a sheet conveyance speed depending on a print duty, and illustrates a relationship of an amount of heat of the heater to the sheet. FIG. 9A illustrates amounts of heat of the heater at respective timings A to C. FIG. 9B illustrates distribution of amounts of heat applied to the sheet. White represents one-pass printing area and gray represents two-pass printing area. Further, FIG. 9B illustrates positional relationship between sheet heating positions of the heater of the drying unit 211 while the sheet is being conveyed, and the ink-applied positions of the head. In this example, there are head positions 1 to 3, which correspond to heater positions 1 to 3.

In FIG. 9A, the timing "A" corresponds to one-pass printing (head position 1). When a print duty in the ink-applied position of the print head is equal to or smaller than a predetermined certain value, the one-pass printing is selected as a standard. The sheet is conveyed at a standard conveyance speed, and an amount of heat of the heater is set to "medium" as the standard. The timing "B" is a timing for two-pass printing (head position 2). When a print duty in the ink-applied position of the print head is larger than the predetermined certain value, two-pass printing is selected. In the two-pass printing, a conveyance speed of the sheet becomes about half compared with the one-pass printing. In accordance with the reduced conveyance speed, an amount of heat of the heater is set to "small" which is smaller than "medium". The timing C is a stage where an operation ends and the process has entered into a discharge operation. The head position 3 is no longer present on the sheet. The conveyance speed becomes much larger than the standard. To match the conveyance speed, an amount of heat of the heater is set to "large" which is larger than "medium". Respective values of "medium" and "large" are set such that a total cumulative amount of heat (amount of heat×time) of the area heated by the heater at this time becomes substantially equal to those at the timing "A" and the timing "B". According to the present example, an area where ink is applied on the sheet will be eventually heated substantially with no unevenness, drying with no unevenness is performed as a whole, and furthermore, printing with less image unevenness and favorable image quality will be performed. As described above, for a number of print passes, one-pass/two-pass is taken here as an example, but a number of passes is not limited to this. Instead, the number of passes may be, for example, two-pass/4-pass, or further increased.

(4) Wait Event Occurrence

A print control for temporarily stopping sheet conveyance when an wait event occurs while print operation is in progress will be described.

Figures 10A, 10B:
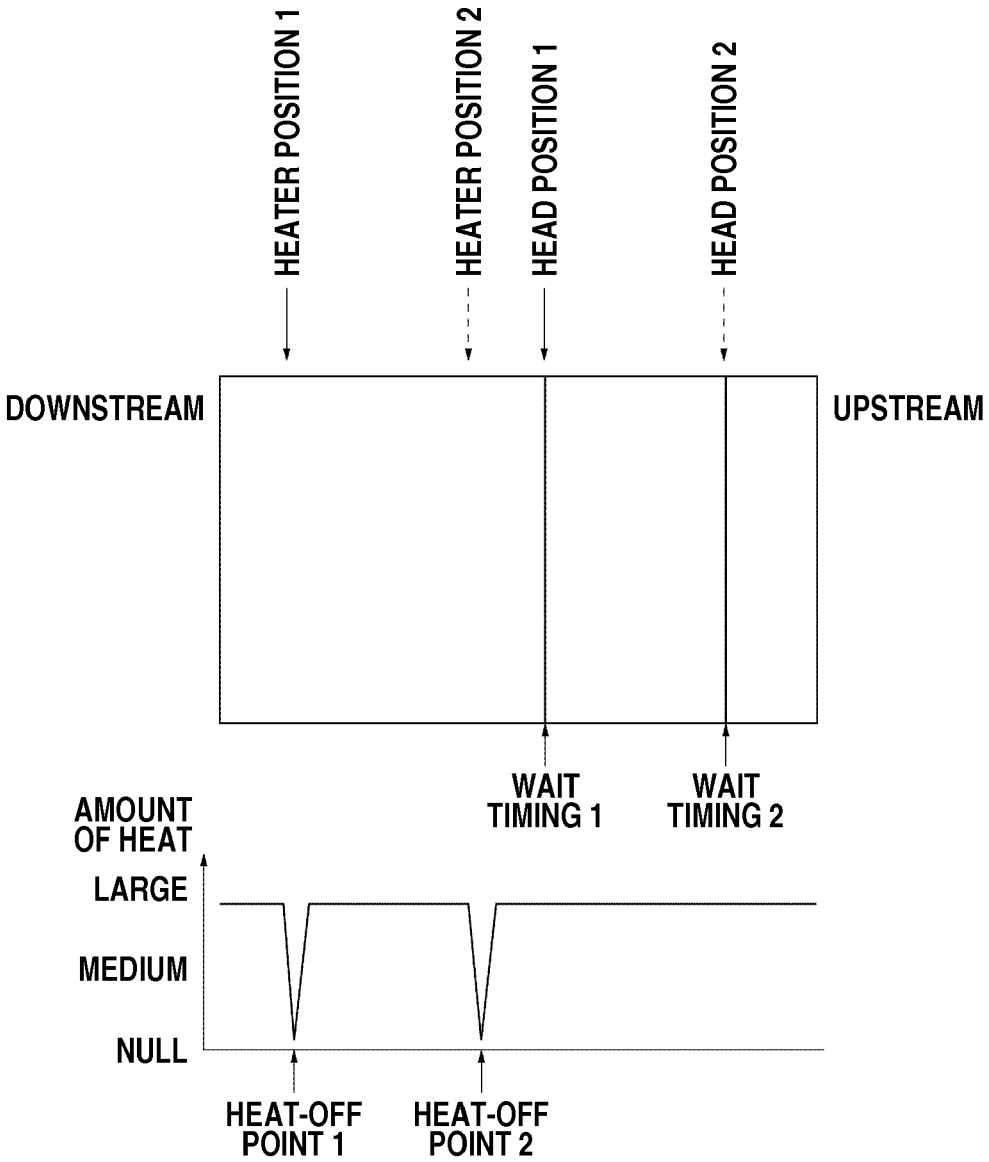
FIGS. 10A and 10B illustrate heater control when a wait event occurs.

FIGS. 10A and 10B illustrate a heater control when a wait occurs, and illustrate a relationship of an amount of heat of the heater to the sheet. FIG. 10A illustrates amounts of heat of the heater in a case where a wait event occurs and in a normal state with no wait event. In a normal state, the sheet is heated by an amount of heat of the heater classed as "large". If a wait occurs, the heater is turned off and an amount of heat is set to "Null". FIG. 10B illustrates distribution of amounts of heat applied to the sheet. In the example, wait events occur at the head position 1 and the head position 2, and the heater position 1 and the heater position 2 correspond to these head positions.

As previously described in FIG. 4 to FIG. 6, a wait event may occur while printing execution is in progress. In a system in which print data is transferred to the printing apparatus from the host PC via an interface such as a LAN, transfer rate of the data is restricted, as the result of which an wait for printing may occur in some cases. On the contrary, the receiving buffer cannot receive the data any more due to data overflow, and then a wait may occur in some cases. Further, the wait may also occur when the receiving buffer cannot keep up with generation of the print data. If the wait event occurs, it is difficult to accurately predict a time required until the wait is released. Consequently, if the wait event occurs and printing operation is stopped, heating by the heater is once turned off, and the wait is prolonged thereby preventing the sheet from being excessively heated. Then, when the wait is released, amount of heat of the heater is returned to the original setting and the print operation is resumed. "Off" herein used is not limited to complete stoppage of heating by the heater, but refers to a mode in which an amount of heat is made smaller than normal and drying capability is small. According to the present example, since the sheet is not excessively heated at a position where conveyance is stopped, drying with no unevenness is carried out as a whole, and furthermore, printing with less image unevenness and favorable image quality is performed.

In the above-described example, amounts of heat of the heater comprise three types (large/medium/small) or two types, but they may be controlled by dividing into further stages. Respective amounts of heat may be variably set to appropriate values depending on types of inks or sheets used. Further, examples illustrated in FIG. 7 to FIG. 10 may be arbitrarily combined. Also in such case, amounts of heat of the heater are set, which match a plurality of conveyance speeds while printing operation of one job is in progress. Further, even with respect to controls other than four printing controls described above, a printing mode is possible that performs control to vary sheet conveyance amounts per unit time while print operation of one job is in progress. In such a case, it is only necessary to perform control to vary the capability of the drying unit to match variation in the sheet conveyance amounts per unit time.

According to the above-described exemplary embodiments, even when the sheet conveyance amount per unit time is varied while the print operation of one job is in progress, the sheet can be evenly dried and degradation of print throughput can be minimized. If a sheet used is a cut-sheet, the one job refers to a print command for performing print operation on a piece of cut-sheet. The control unit performs control to vary a sheet conveyance amount per unit time while print operation of a piece of cut-sheet is in progress, so as to accordingly vary the capability of the drying unit. If a sheet used is a continuous sheet, the one job refers to a print command of one unit length (thereafter the continuous sheet is cut for each unit length) when print operation of a plurality of images is continuously performed. The control unit performs control to vary the sheet conveyance amount per unit time when the print operation of one unit length is in progress during a continuous printing, so as to accordingly vary the capability of the drying unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-257418 filed Nov. 10, 2009, which is hereby incorporated by reference herein in its entirety.

What is claimed is:

1. A printing apparatus, comprising:

a conveying mechanism configured to convey a sheet;

a printing unit configured to apply an ink onto the sheet conveyed by the conveying mechanism to perform print operation;

a drying unit configured to dry the sheet on which ink has been applied by the printing unit; and a control unit configured to control the conveying mechanism, the printing unit, and the drying unit, wherein, while the print operation is in progress, the control unit controls the conveying mechanism to reduce a sheet conveyance amount per unit time and the drying unit to reduce drying power when a predetermined area of the sheet near a trailing edge is being printed, compared to a time when an area prior to the predetermined area of same sheet has been printed.

2. The printing apparatus according to claim 1, wherein a length of a conveyance path between the printing unit and the drying unit is shorter than a length of a sheet to be used as measured in a conveying direction of the sheet to be used.

3. The printing apparatus according to claim 1, wherein the control unit controls the drying unit to vary the sheet conveyance amount per unit time and to vary a capability of the drying unit depending on duty of print.

4. The printing apparatus according to claim 1, wherein the control unit, if a wait event occurs while print operation is in progress, performs control to temporarily stop the sheet conveyance and to reduce a capability of the drying unit.

5. The printing apparatus according to claim 1, wherein the control unit performs control, in an operation for discharging a sheet upon completion of printing, to increase the sheet conveyance amount per unit time and to increase a capability of the drying unit.

6. The printing apparatus according to claim 1, wherein the sheet is a cut-sheet, and a sheet conveyance amount per unit time is varied while print operation of a piece of cut-sheet is in progress.

7. The printing apparatus according to claim 1, wherein the sheet is a continuous sheet, and printing of a plurality of images is performed continuously, and a sheet conveyance amount per unit time is varied while print operation of one image is in progress.

8. A printing apparatus, comprising:

a conveying mechanism configured to convey a sheet;

a printing unit configured to apply an ink onto the sheet conveyed by the conveying mechanism to perform print operation;

a drying unit configured to dry the sheet on which ink has been applied by the printing unit; and a control unit configured to control the conveying mechanism, the printing unit, and the drying unit, wherein, while the print operation of one job is in progress, the control unit, if image data of print of the one job is mixed in a printing area and a non-printing area in a conveying direction of the sheet, performs control to increase a sheet conveyance amount per unit time and to increase drying power of the drying unit, when the non-printing area passes through the printing unit, compared to a time when the printing area passes through the printing unit.

9. The printing apparatus according to claim 8, wherein a length of a conveyance path between the printing unit and the drying unit is shorter than a length of a sheet to be used as measured in a conveying direction of the sheet to be used.

10. The printing apparatus according to claim 8, wherein the control unit performs control, in an operation for discharging a sheet upon completion of printing, to increase the sheet conveyance amount per unit time and to increase a capability of the drying unit.

11. The printing apparatus according to claim 8, wherein the sheet is a cut-sheet, and a sheet conveyance amount per unit time is varied while print operation of a piece of cut-sheet is in progress.

12. The printing apparatus according to claim 8, wherein the sheet is a continuous sheet, and printing of a plurality of images is performed continuously, and a sheet conveyance amount per unit time is varied while print operation of one image is in progress.

* * * * *